US007104023B1

(12) United States Patent
Holztrager

(10) Patent No.: US 7,104,023 B1
(45) Date of Patent: Sep. 12, 2006

(54) WALL ORGANIZER

(75) Inventor: William H. Holztrager, Bristol, TN (US)

(73) Assignee: Showall, Inc., Chilhowie, VA (US)

( * ) Notice: Subject to any disclaimer, the term of this patent is extended or adjusted under 35 U.S.C. 154(b) by 94 days.

(21) Appl. No.: 10/685,483

(22) Filed: Oct. 16, 2003

(51) Int. Cl.
*E04C 1/10* (2006.01)

(52) U.S. Cl. ..... 52/705; 52/36.4; 52/36.5; 211/94.01; 211/189

(58) Field of Classification Search ..... 52/705, 52/36.4, 36.5; 40/611.08, 618, 620; 211/94.01, 211/189, 13
See application file for complete search history.

(56) References Cited

U.S. PATENT DOCUMENTS 4,674,240 A * 6/1987 Strausheim ..... 52/36.4
4,752,010 A 6/1988 Holztrager
4,944,416 A * 7/1990 Petersen et al. ..... 52/36.5
5,101,986 A * 4/1992 Holztrager ..... 211/85.1
5,485,934 A 1/1996 Holztrager
5,899,344 A * 5/1999 Current et al. ..... 211/94.01
5,921,044 A 7/1999 Holztrager
5,941,026 A * 8/1999 Eisenreich et al. ..... 52/36.5
5,983,574 A 11/1999 Holztrager
6,349,507 B1 * 2/2002 Muellerleile ..... 52/36.5
D471,993 S 3/2003 Holztrager

* cited by examiner

*Primary Examiner*—Basil Katcheves
(74) *Attorney, Agent, or Firm*—Shlesinger, Arkwright & Garvey LLP

(57) ABSTRACT

A wall organizer comprises a first slatwall member secured to a wall, the first slatwall member having a plurality of first grooves having a first center-to-center groove spacing between said first grooves; a second slatwall member secured to the wall above or below the first slatwall member, the second slatwall member having a plurality of second grooves having a second center-to-center groove spacing between said second grooves; and at least another first or second slatwall member secured to the wall above or below one of the first and second slatwall members.

17 Claims, 4 Drawing Sheets

WALL ORGANIZER

FIELD OF THE INVENTION

The present invention relates generally to slatwall wall assemblies and particularly to a wall organizer using slatwall members for use in garages, room closets, workstations and closets in a home or office.

BACKGROUND OF THE INVENTION

There is a need for a wall organizer that can be fairly easily installed using at least two slatwall members having different center-to-center groove spacings to efficiently store articles, such as handtools, on a given wall space.

OBJECTS AND SUMMARY OF THE INVENTION

It is an object of the present invention to provide a wall organizer having a plurality of horizontal grooves adapted to accept standard hanging hardware for supporting articles, such as handtools, and that can be assembled using at least two slatwall members of different center-to-center groove spacings to provide flexibility and efficient use of the wall space in terms of number and size of articles that can be hung from the organizer.

It is another object of the present invention to provide a wall organizer having a plurality of horizontal grooves adapted to accept standard hanging hardware for supporting articles, such as handtools, that can be made into any configuration of smaller or larger amounts of grooves having a particular center-to-center groove spacing.

A wall organizer comprises a first slatwall member secured to a wall, the first slatwall member having a plurality of first grooves having a first center-to-center groove spacing between said first grooves; a second slatwall member secured to the wall above or below the first slatwall member, the second slatwall member having a plurality of second grooves having a second center-to-center groove spacing between said second grooves; and at least another first or second slatwall member secured to the wall above or below one of the first and second slatwall members.

These and other objects of the present invention will become apparent from the following detailed description.

BRIEF DESCRIPTIONS OF THE DRAWINGS

DETAILED DESCRIPTION OF THE INVENTION

Figure 1:
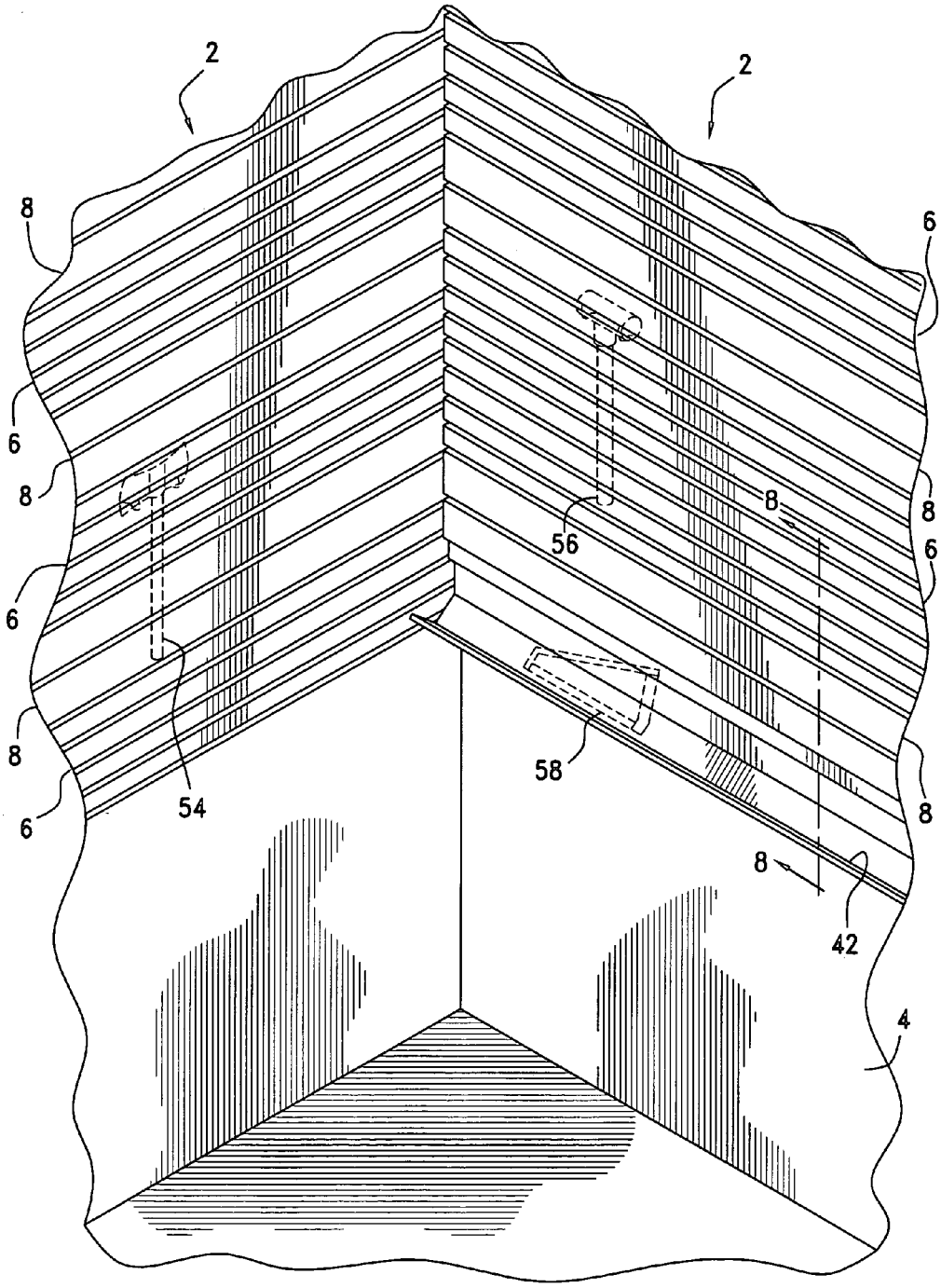
FIG. 1 is a perspective view of a corner wall equipped with a wall organizer made in accordance with the present invention.
Figure 2:
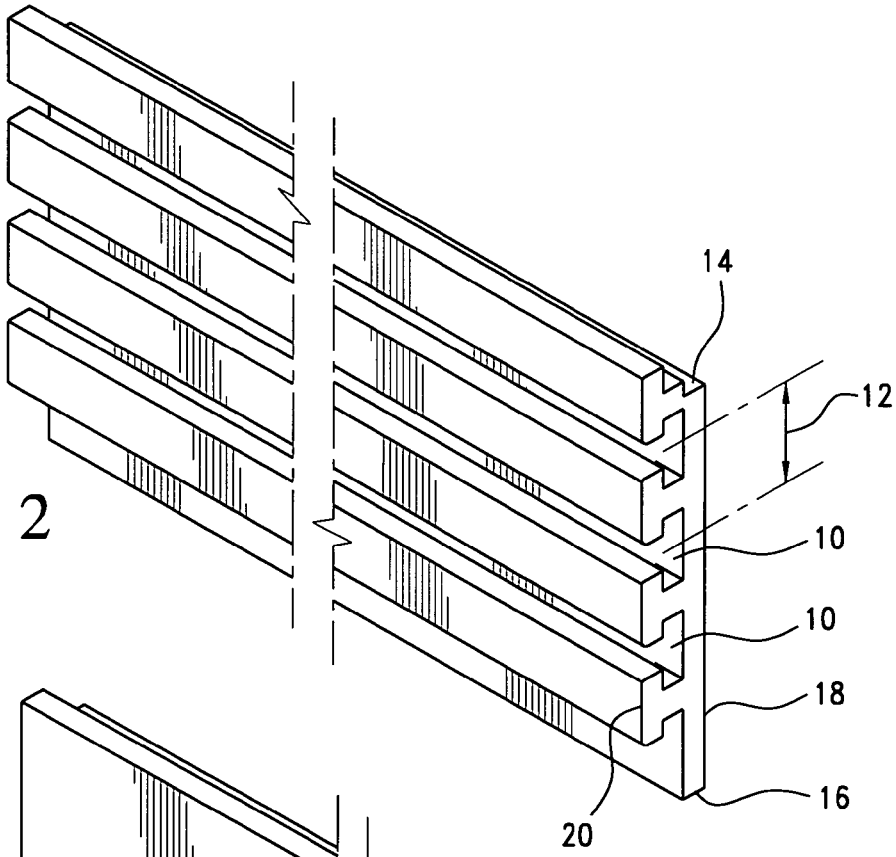
FIGS. 2 and 3 are perspective views of slatwall members used to make up the wall organizer of FIG. 1.
Figure 3:
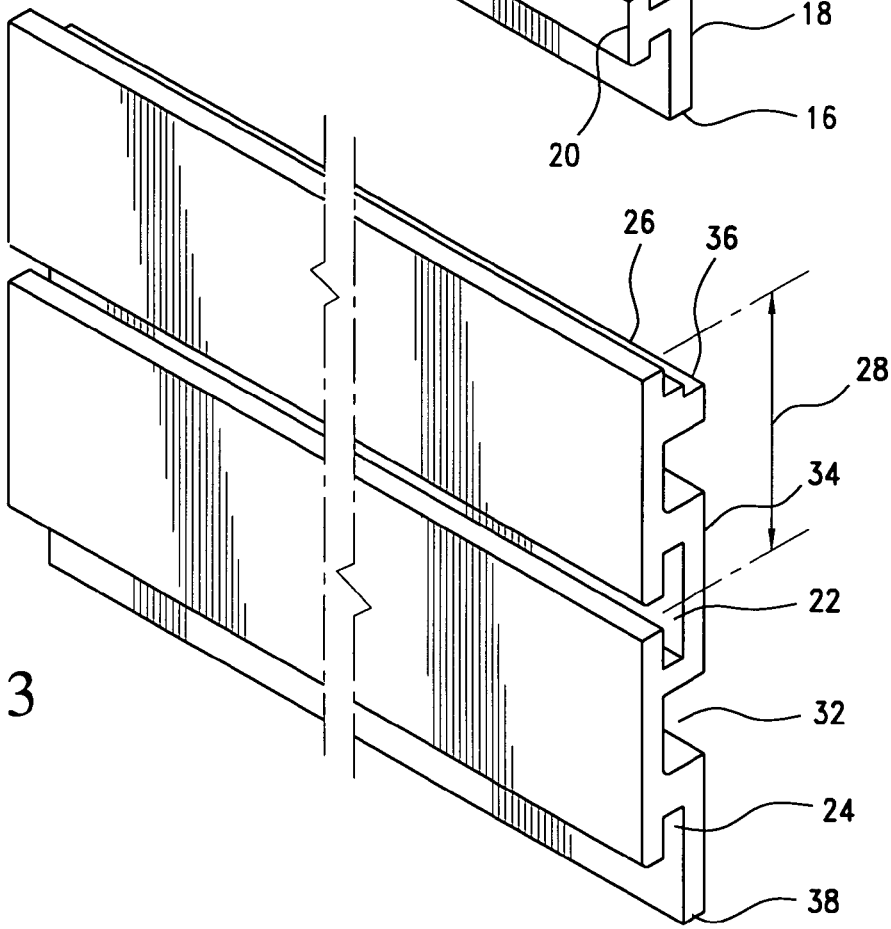
Figure 4:
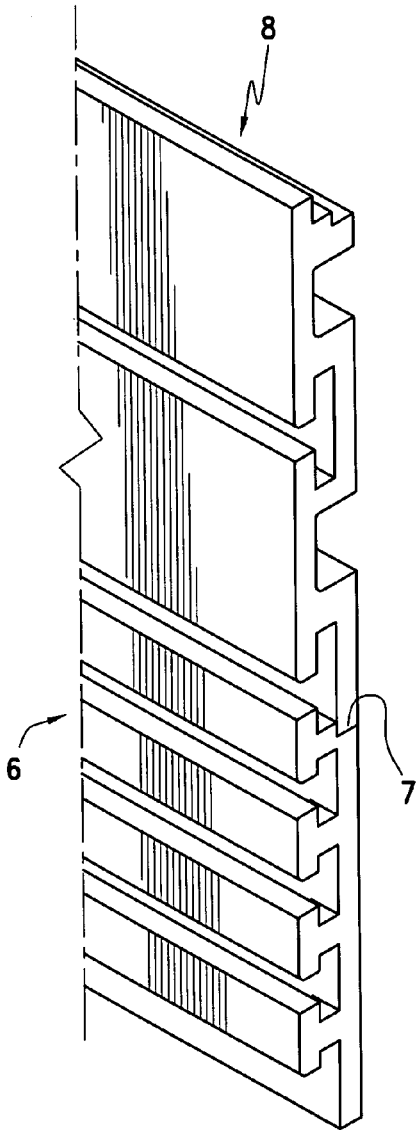
FIGS. 4 and 5 are perspective views of the slatwall members shown in FIGS. 2 and 3 assembled in a top-edge-to-bottom-edge configuration.
Figure 5:
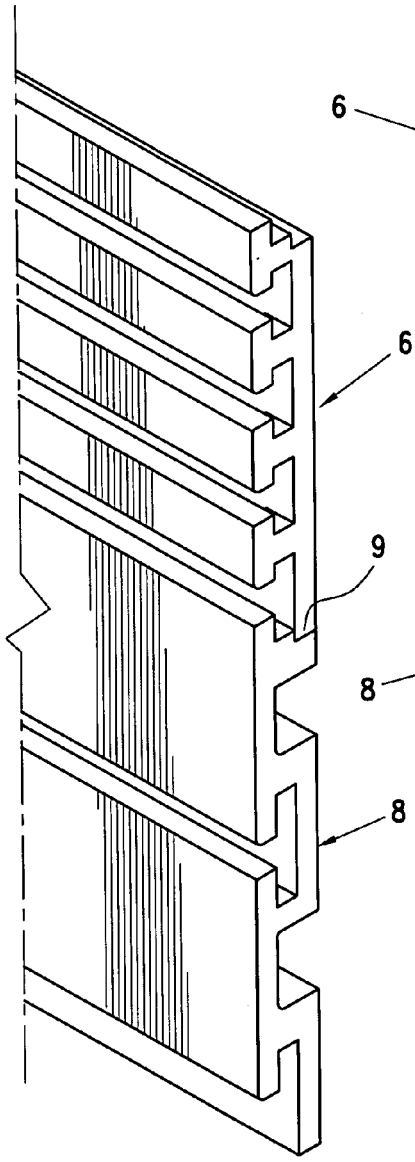

A wall organizer 2 made in accordance with the present invention is disclosed in FIG. 1. The wall organizer 2 is shown secured to an existing wall 4, such as a garage wall or closet wall. The wall 4 may not include a wallboard, in which case the wall organizer 2 is attached directly to the existing framework or studs normally used to hold the wallboard. The wall organizer 2 is made from a plurality of slatwall members 6 and 8, as shown in FIGS. 2 and 3, which are then secured on top of or below each other, as shown in FIGS. 4 and 5 with rabbet joints 7 and 9. Any desired number or combination of the slatwall member 6 and 8 may be used to suit a particular application.

The slatwall member 6 has a plurality of grooves 10, preferably T-shaped in cross-section, that are co-extensive with the length of the member and lie in parallel, predetermined spaced relationship with each other. The grooves 10 are used to hold standard types of support members from which articles, such as handtools, may be supported. The grooves 10 are spaced apart from each other at a constant center-to-center groove spacing 12.

The slatwall member 6 has a rabbet recess 14 along its upper edge that is configured to receive a corresponding lower edge 16 of a super-adjacent slatwall member 6 or 8. The slatwall member 6 has a base wall portion 18 and a plurality of T-shaped ribs 20 that form between them the T-shaped grooves 10. The slatwall member 6 is preferably of extruded plastic construction of polyvinylchloride or other suitable material.

Although the slatwall member 6 is shown with a specific number of grooves 10, it should be understood that it can made with a different number of grooves.

The slatwall member 8 has a T-shaped groove 22 and portions of a groove 24 and 26 which will make a full groove when joined to a respective upper and lower slatwall member 6 or 8, as shown in FIGS. 4 and 5. The groove 22 and the groove portions 24 and 26 are co-extensive with the length of the member and lie in parallel spaced relationship. A center-to-center groove spacing 28 from the groove 22 to the groove portion 24 or 26 is preferably longer than the center-to-center groove spacing 12 of the slatwall member 6. The difference in the center-to-center groove spacings advantageously provides flexibility in terms of the standard hardware that may be used for supporting the articles from the wall organizer and the spacing of the articles from each other.

The slatwall member 8 is also an extruded plastic construction of polyvinylchloride or other suitable material. Although shown with one full groove, it may be extruded with more or less number of grooves.

The slatwall member 8 has a plurality of $\pi$ (pi)-shaped portions 32 joined to each other by a base wall portion 34. The pi-shaped configuration of the slatwall member 8 advantageously uses less material compared to a solid base wall construction. The slatwall member 8 has a rabbet recess 36 configured to receive the lower edge 16 of the slatwall member 6 disposed above or the lower edge 38 of another super-adjacent slatwall member 8.

Figure 8:
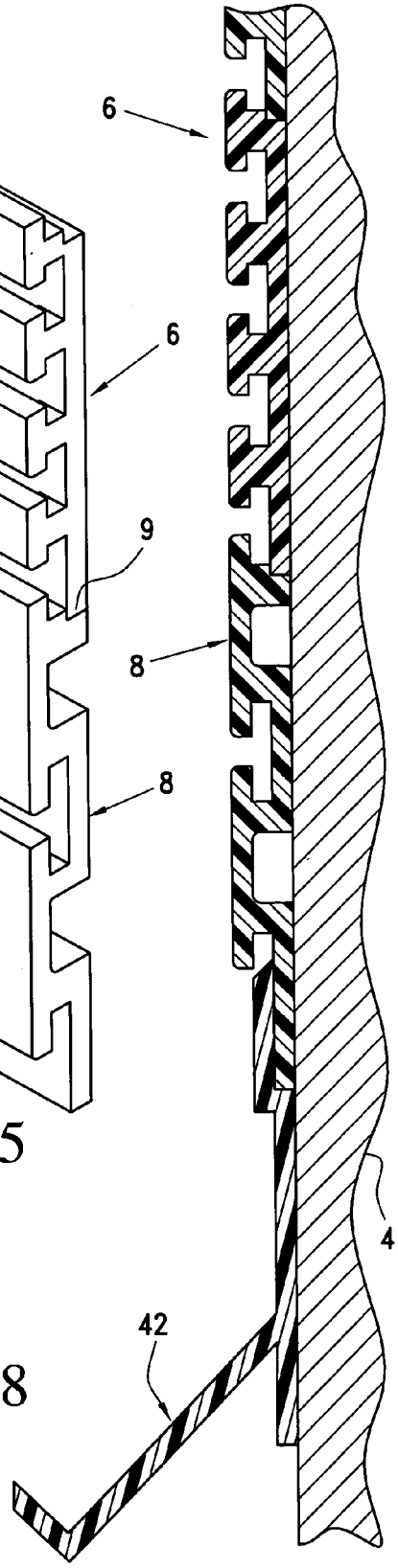
FIG. 8 is a cross-sectional view taken along line 8—8 of FIG. 1.
Figure 6:
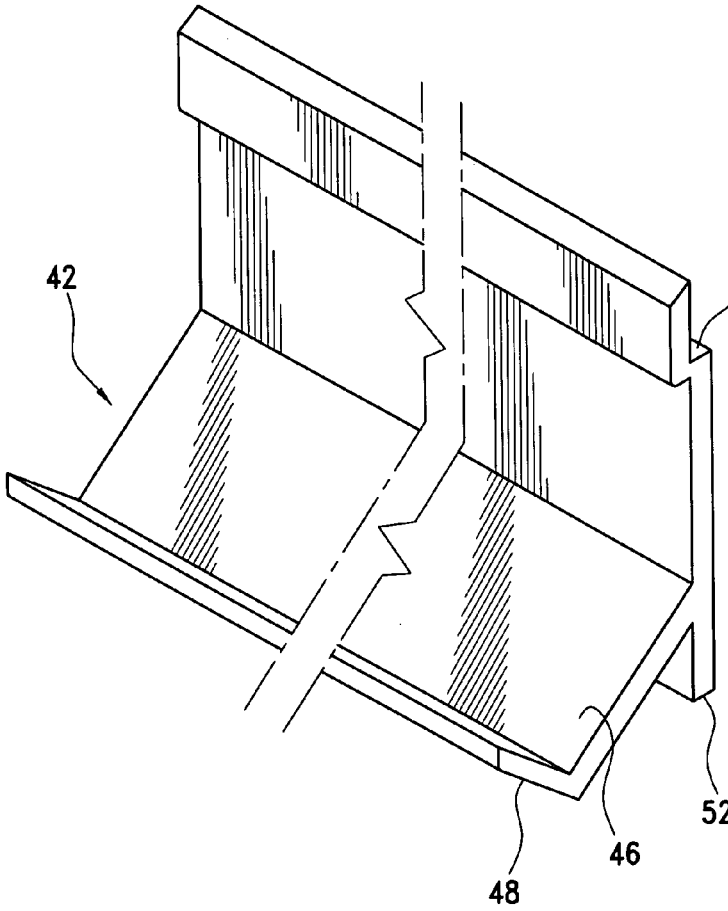
FIG. 6 is a perspective view of a shelf member used in the wall organizer of FIG. 1.
Figure 7:
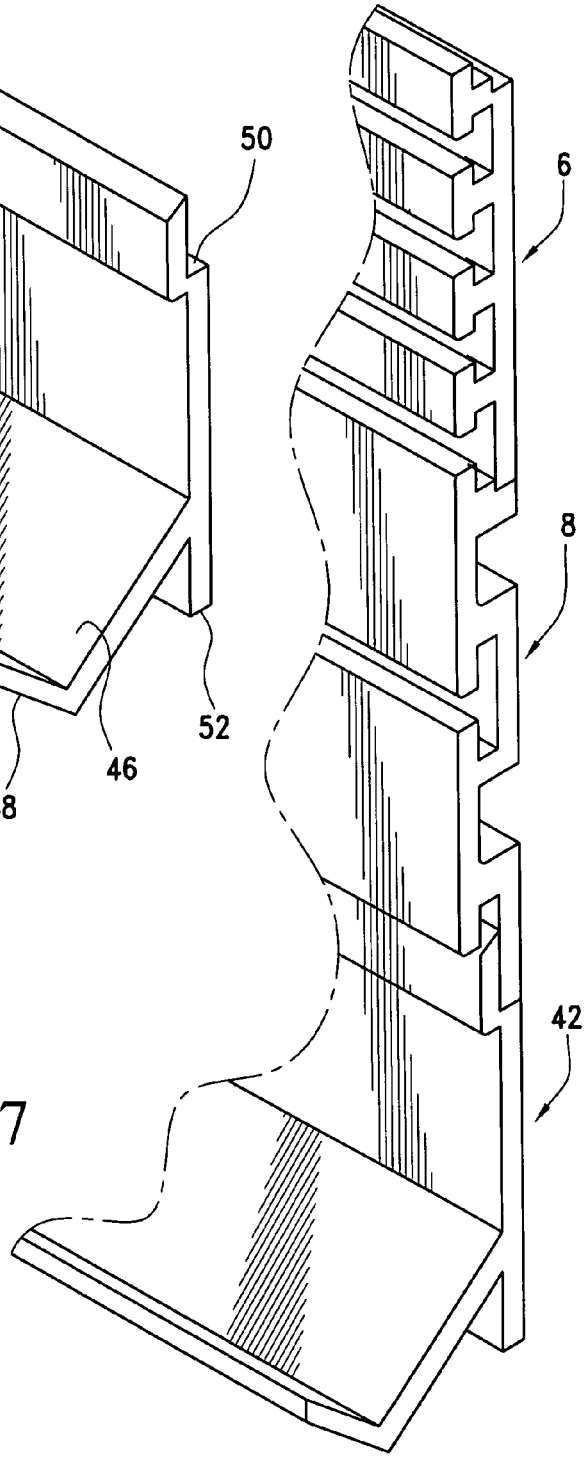
FIG. 7 is a perspective view of a wall organizer using the slatwall members of FIGS. 2 and 3 and the shelf member of FIG. 6.

Referring back to FIG. 1, a wall organizer 2 may include a shelf member 42. Referring to FIGS. 6 and 7, the shelf member 42 includes a base wall 44 and a shelf portion 46 extending outwardly from the base wall portions 44. A front wall portion 48 extends transversely from the front edge of the shelf portion 46. Although the shelf portion 46 is shown inclining downwardly, it may also extend horizontally from the base wall portion 44. The shelf member 42 has a rabbet recess 50 configured to receive the lower edge portion 38 of the slatwall member 8 or the lower edge 16 of the slatwall member 6, as best shown in FIGS. 7 and 8. The base wall portion 44 includes a lower edge portion 52 which is adapted to be received within the rabbet recess 36 of the slatwall member 8 or the rabbet recess 14 of the slatwall member 6. The lower edge 52 is also configured to be received in the rabbet recess 50 of another sub-adjacent shelf member 42. The shelf member 42 is preferably of extruded plastic construction of polyvinylchloride or other suitable material. The shelf member 42 is disclosed in U.S. Pat. No. 5,101,986.

The wall organizer 2 is constructed by securing the slatwall members 6 and 8 to the wall 4. A number of the slatwall members 6 and 8 are used to cover an area of the wall as needed. The shelf member 42 may be used anywhere on the wall, such as at the bottom of the lowest slatwall member 6 or 8, as desired.

In use, standard hardwares (not shown) are inserted into the grooves 10 or 22. The hardwares are in turn used to hang tools or articles such as an ax 54 or a hammer 56, as shown in dashed lines in FIG. 1. The shelf member 42 may be used to hold other articles 58, as shown in dashed lines.

The rabbet recess 14 and 36 and the cooperating lower edges 16 and 38 provide the means for interlocking one slatwall member to another slatwall member.

Although the slatwall members 6 and 8 are shown with T-shaped grooves, other groove configurations may be used, such as those disclosed in U.S. Pat. No. 5,485,934, D471, 993, or 4,752,010, hereby incorporated by reference.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A wall organizer, comprising:

a) a first slatwall member having a plurality of first grooves having a first center-to-center groove spacing between said first grooves, said first slatwall member is for securing secured to a wall;

b) a second slatwall member having a second groove and portions of a groove that each forms a groove with an adjacent first or second slatwall member and having a second center-to-center groove spacing between said second groove and an adjacent groove formed from one of said portions of a groove and said adjacent first or second slatwall member, said second slatwall member is for securing to said wall above or below said first slatwall member;

c) at least another first or second slatwall member secured to said wall above or below one of said first and second slatwall members; and d) said first center-to-center groove spacing is not equal to said second center-to-center groove spacing.

2. A wall organizer as in claim 1, wherein said first and second grooves are T-shaped in cross-section.

3. A wall organizer as in claim 1, wherein said first slatwall member includes means for interlocking with another first slatwall member.

4. A wall organizer as in claim 1, wherein said second slatwall member includes means for interlocking with another second slatwall member.

5. A wall organizer as in claim 1, wherein:

a) said first slatwall member includes means for interlocking with said second slatwall member; and b) said second slatwall member includes means for interlocking with said first slatwall member.

6. A wall organizer as in claim 1, wherein said first slatwall member is joined to said second slatwall member with a rabbet joint.

7. A wall organizer as in claim 1, wherein:

a) said first slatwall member includes a first bottom and a first top peripheral edge;

b) said first top peripheral edge includes a first rabbet slot; and c) said first bottom peripheral edge of an adjacent first slatwall member fits within said first rabbet slot.

8. A wall organizer as in claim 1, wherein:

a) said second slatwall member includes a second bottom and a second top peripheral edge;

b) said second top peripheral edge includes a second rabbet slot; and c) said second bottom peripheral edge of an adjacent second slatwall member fits within said second rabbet slot.

9. A wall organizer as in claim 1 wherein said first slatwall member includes a basewall portion and a plurality of T-shaped rib portions secured to said basewall portion.

10. A wall organizer as in claim 1, wherein said second slatwall member includes a number of Pi-shaped portions joined to each other by a basewall portion.

11. A wall organizer as in claim 1, wherein said first and second slatwall members are extruded plastic.

12. A wall organizer as in claim 1, wherein:

a) said first slatwall member includes a first bottom and a first top peripheral edge;

b) said first top peripheral edge includes a first rabbet slot;

c) said second slatwall member includes a second bottom and a second top peripheral edge;

d) said second top peripheral edge includes a second rabbet slot;

e) said first or second bottom peripheral edge of an adjacent first or second slatwall member, respectively, fits within said first rabbet slot to form one of said said first or second grooves; and f) said first or second bottom peripheral edge of an adjacent first or second slatwall member, respectively, fits within said second rabbet slot to form one of said first or second grooves.

13. A wall organizer as in claim 12, wherein said first and second peripheral edges are stairs-shaped in cross-section.

14. A wall organizer, comprising:

a) a first slatwall member having a plurality of first grooves having a first center-to-center groove spacing between said first grooves, said first slatwall member is secured to a wall;

b) a second slatwall member having a second groove and portions of a groove that each forms a groove with an adjacent first or second slatwall member and having a second center-to-center groove spacing between said second groove and an adjacent groove formed from one of said portions of a groove and said adjacent first or second slatwall member, said second slatwall member is for securing to said wall above or below said first slatwall member;

c) a shelf member secured to said wall below said first or second slatwall member; and d) said first center-to-center groove spacing is not equal to said second center-to-center groove spacing.

15. A wall organizer as in claim 14, wherein said shelf member includes an inclined shelf portion with a transverse wall portion.

16. A wall organizer as in claim 14, wherein said shelf member includes means for interlocking with said first or second slatwall member.

17. A wall organizer as in claim 14, wherein:

a) said first and second slatwall members each includes a bottom peripheral edge;

b) said shelf member includes a top portion having recess; and c) said bottom peripheral is received within said recess.

* * * * *